US012673398B2

(12) United States Patent
Hoshikawa et al.

(10) Patent No.: US 12,673,398 B2
(45) Date of Patent: Jul. 7, 2026

(54) METHOD OF MANUFACTURING GRINDING WHEEL

(71) Applicant: DISCO CORPORATION, Tokyo (JP)

(72) Inventors: Hirotoshi Hoshikawa, Tokyo (JP); Xiaoming Qiu, Tokyo (JP); Masashi Aoki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 426 days.

(21) Appl. No.: 18/302,238

(22) Filed: Apr. 18, 2023

(65) Prior Publication Data

US 2023/0339075 A1 Oct. 26, 2023

(30) Foreign Application Priority Data

Apr. 20, 2022 (JP) ..... 2022-069402

(51) Int. Cl.
*B24D 18/00* (2006.01)
*B24D 5/02* (2006.01)

(52) U.S. Cl.
CPC ..... *B24D 18/0072* (2013.01); *B24D 5/02* (2013.01)

(58) Field of Classification Search
None
See application file for complete search history.

(56) References Cited

U.S. PATENT DOCUMENTS

2003/0032382 A1* 2/2003 Suzuki ..... B24D 7/10 451/450
2016/0265570 A1* 9/2016 Sabau ..... B29C 66/0246
2020/0070313 A1 3/2020 Mao et al.

FOREIGN PATENT DOCUMENTS

CN 110977798 A 4/2020
JP 2000288881 A 10/2000

OTHER PUBLICATIONS

Office Action issued in counterpart Singapore patent application No. 10202301060P, dated Dec. 2, 2024.

* cited by examiner

*Primary Examiner* — Brian D Keller
*Assistant Examiner* — Jason Khalil Hawkins
(74) *Attorney, Agent, or Firm* — Greer, Burns & Crain, Ltd

(57) ABSTRACT

A method of manufacturing a grinding wheel includes a surface unevenness forming step of applying ultrasonic vibrations from an ultrasonic vibration applying unit through water to an annular slot defined in a surface of an annular base along circumferential directions thereof, thereby forming surface unevennesses on either one or both of a side surface and a bottom surface of the annular slot, and, after the surface unevenness forming step, a grindstone fixing step of fixing a plurality of grindstones to the annular slot with an adhesive.

6 Claims, 11 Drawing Sheets

METHOD OF MANUFACTURING GRINDING WHEEL

BACKGROUND OF THE INVENTION

Field of the Invention

The present invention relates to a method of manufacturing a grinding wheel for use in grinding a workpiece and a grinding wheel.

Description of the Related Art

Electronic appliances such a cellular phones and personal computers incorporate device chips including such devices as integrated circuits (ICs). For manufacturing device chips, the reverse side of a wafer with a plurality of devices on its face side is ground to thin down the wafer, and the wafer is then divided into individual pieces as device chips including the respective devices. Wafers are ground by a grinding apparatus. There has been known in the art a grinding apparatus that roughly grinds the reverse side of a wafer with a roughly grinding unit and then finishingly grinds the reverse side of the wafer with a finishingly grinding unit (see Japanese Patent Laid-open No. 2000-288881).

The roughly grinding unit has a first spindle extending substantially parallel to vertical directions and a roughly grinding wheel mounted on the lower end of the first spindle. Similarly, the finishingly grinding unit has a second spindle extending substantially parallel to vertical directions and a finishingly grinding wheel mounted on the lower end of the second spindle. Each of the roughly grinding wheel and the finishingly grinding wheel has an annular base made of metal. The annular base has an annular slot defined in a surface thereof and extending along circumferential directions of the annular base, the annular slot having a predetermined width. A plurality of grindstones are disposed in the annular slot and spaced at substantially equal intervals along the circumferential directions of the annular base.

Each of the grindstones is fixed to the annular base by an adhesive. The width of the annular slot is small as it is a few millimeters wide, and each of the grindstones has one half or more protruding thicknesswise from the surface of the annular base. Therefore, unless the grindstones are fixed to the annular base with enough bonding strength, the grindstones may come off the annular base while they are in the process of grinding a wafer.

SUMMARY OF THE INVENTION

It is therefore an object of the present invention to increase the bonding strength with which grindstones are fixed to an annular base.

In accordance with an aspect of the present invention, there is provided a method of manufacturing a grinding wheel, including a surface unevenness forming step of applying ultrasonic vibrations from an ultrasonic vibration applying unit through water to an annular slot defined in a surface of an annular base along circumferential directions thereof, thereby forming surface unevennesses on either one or both of a side surface and a bottom surface of the annular slot, and, after the surface unevenness forming step, a grindstone fixing step of fixing a plurality of grindstones to the annular slot with an adhesive.

In accordance with another aspect of the present invention, there is provided a grinding wheel including an annular base having an annular slot defined in a surface thereof along circumferential directions thereof, and a plurality of grindstones fixed to the annular slot by an adhesive, in which the annular slot is defined by a side surface having first surface unevennesses that are periodic in thicknesswise directions perpendicular to the circumferential directions, the annular slot is defined by a bottom surface having second surface unevennesses that are periodic in radial directions perpendicular to the circumferential directions and the thicknesswise directions, and either one or both of the side surface and the bottom surface of the annular slot have third surface unevennesses having a depth smaller than that of the first surface unevennesses and the second surface unevennesses.

In the method of manufacturing a grinding wheel according to the aspect of the present invention, ultrasonic vibrations are applied from the ultrasonic vibration applying unit through water to the annular slot defined in the surface of the annular base, thereby forming surface unevennesses on either one or both of the side surface and the bottom surface of the annular slot (the surface unevenness forming step). Since the surface unevennesses formed in the annular slot by the ultrasonic vibrations applied thereto increase the area of contact between the annular base and the adhesive, the bonding strength with which the grindstones are fixed to the annular base is increased.

The grinding wheel according to the other aspect of the present invention includes the third surface unevennesses that are defined in either one or both of the side surface and the bottom surface of the annular slot and that have a depth smaller than that of the first surface unevennesses and the second surface unevennesses. Since the third surface unevennesses increase the area of contact between the annular base and the adhesive, the bonding strength with which the grindstones are fixed to the annular base is increased.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
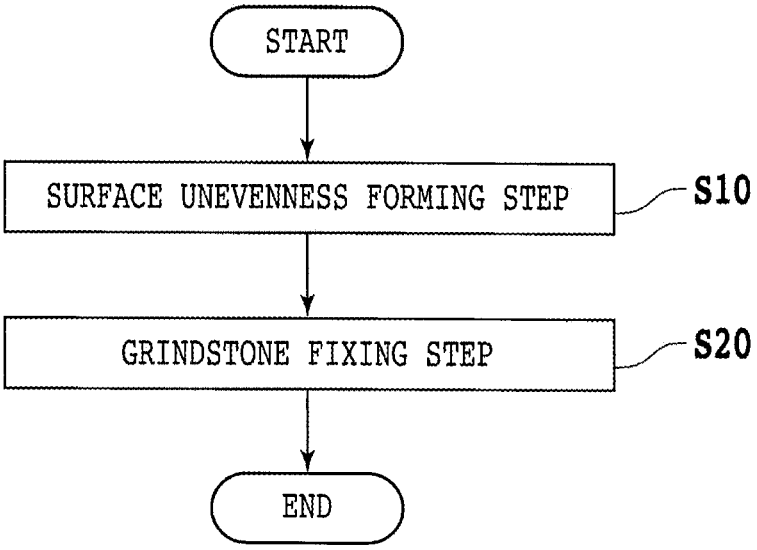
FIG. 1 is a flowchart of a method of manufacturing a grinding wheel according to an embodiment of the present invention.

A preferred embodiment of the present invention will be described in detail below with reference to the accompanying drawings. FIG. 1 is a flowchart of a method of manufacturing a grinding wheel 2 (see FIG. 5) according to the present embodiment. First, the structural details of the grinding wheel 2 will be described below with reference to FIGS. 4 and 5. The grinding wheel 2 has an annular base 4 and a plurality of grindstones 6 fixed thereto. The annular base 4 is made of a metal material such as an aluminum alloy. The annular base 4 has an annular surface 4*a* and another annular surface 4*b* that lie opposite to each other and parallel substantially to each other. The grindstones 6 to be described later are fixed to the annular surface 4*a* that is illustrated as an upper surface in FIG. 5.

Figure 5:
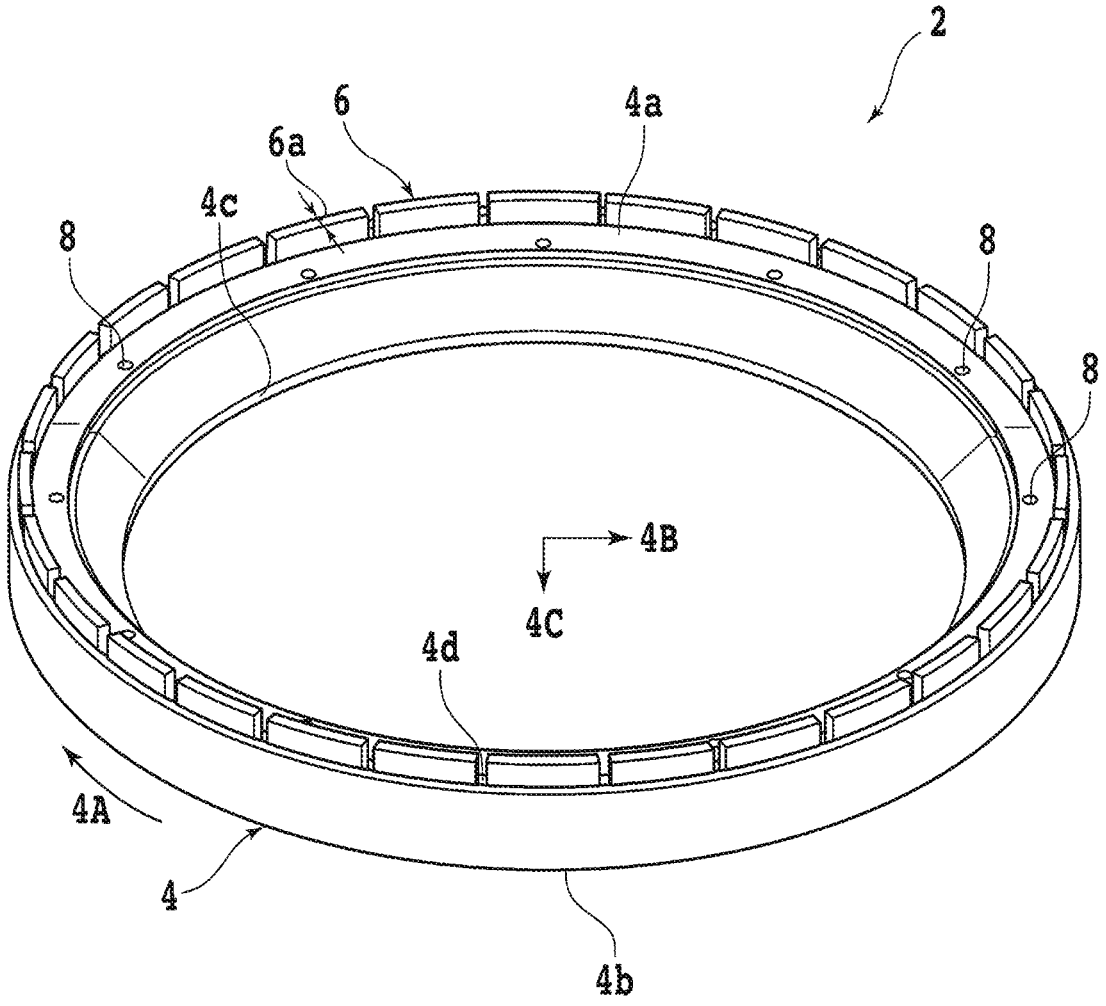
FIG. 5 is a perspective view of a grinding wheel according to the embodiment.

The other annular surface 4*b* that is illustrated as a lower surface in FIG. 5 is fastened to an unillustrated wheel mount by bolts or the like. The annular surfaces 4*a* and 4*b* have substantially equal outside diameters. The annular base 4 has an outer circumferential side surface as a cylindrical side surface extending substantially perpendicularly to the annular surfaces 4*a* and 4*b*. The annular surface 4*a* has an inside diameter that is larger than the inside diameter of the other annular surface 4*b*. Therefore, the annular base 4 has an inner circumferential side surface including a radially inwardly slanted surface. The annular base 4 has an opening 4*c* defined centrally in radial directions 4B thereof and extending axially from the annular surface 4*a* to the other annular surface 4*b*.

The annular surface 4*a* has an annular slot 4*d* that is defined therein and that extends along circumferential directions 4A of the annular base 4. The annular slot 4*d* has a width whose value ranges from 2.0 mm to 4.0 mm, for example. The grindstones 6 are disposed in the annular slot 4*d* and spaced at substantially equal intervals along the circumferential directions 4A of the annular base 4. Each of the grindstones 6 is produced by mixing a binder of metal, ceramic, resin, or the like with super abrasive grains of diamond, cubic boron nitride (cBN), or the like, and molding and sintering the mixture. Each of the grindstones 6 has a width, i.e., a segment width, 6*a* that is substantially the same as the width of the annular slot 4*d*. Each of the grindstones 6 has a base end portion 6*b* (see FIG. 4) placed in and secured to the annular slot 4*d* by an adhesive 7. According to the present embodiment, the adhesive 7 is made of a thermosetting resin such as an epoxy resin. According to the present invention, however, the adhesive 7 is not limited to such a material, and may be made of other materials.

Each of the grindstones 6 fixed to the annular base 4 has a height 6*c* between its upper and lower ends. Two thirds of the height 6*c* protrude upwardly from the annular surface 4*a*. The length of the portion of the height 6*c* that protrudes upwardly from the annular surface 4*a* is referred to as a segment height. The segment height is of a predetermined value ranging from 4.0 mm to 15.0 mm, for example. The annular base 4 has a plurality of grinding liquid supply ports 8 defined therein radially inwardly of the annular slot 4*d* in the annular surface 4*a* with respect to the radial directions 4B of the annular base 4. The grinding liquid supply ports 8 are spaced at substantially equal intervals along the circumferential directions 4A of the annular base 4. When the grinding wheel 2 grinds a wafer, unillustrated grinding water such as pure water is supplied from the grinding liquid supply ports 8 to the grindstones 6.

Figure 2:
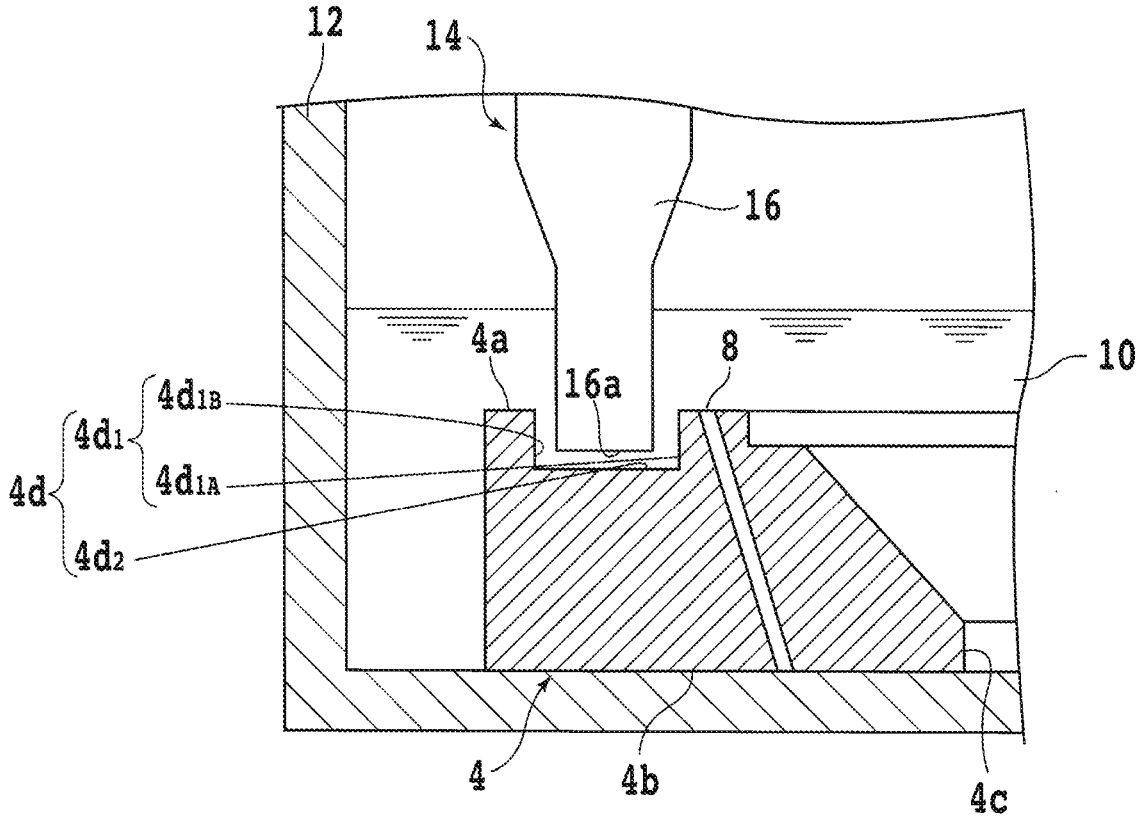
FIG. 2 is a fragmentary cross-sectional view illustrating a surface unevenness forming step of the method according to the embodiment.

The method of manufacturing the grinding wheel 2 according to the present embodiment will be described below with reference to the flowchart illustrated in FIG. 1. In the method of manufacturing the grinding wheel 2 according to the present embodiment, first, ultrasonic vibrations are applied through water 10 such as pure water to the annular slot 4*d* to form surface unevennesses (surface unevenness forming step S10) in the annular slot 4*d*, as illustrated in FIG. 2. The surface unevennesses that are formed in the annular slot 4*d* by the applied ultrasonic vibrations in the surface unevenness forming step S10 are referred to as third surface unevennesses $4e_3$ (see FIG. 3B).

FIG. 2 illustrates in fragmentary cross section the surface unevenness forming step S10 of the method according to the present embodiment. In the surface unevenness forming step S10, as illustrated in FIG. 2, the annular base 4 with the surface 4*a* facing upwardly is immersed in a water tank 12 that contains a predetermined amount of water 10 therein. Then, a vibration amplifying and transmitting member 16 of an ultrasonic vibration applying unit 14 is placed in the annular slot 4*d* and applies ultrasonic vibrations to the annular base 4.

The ultrasonic vibration applying unit 14 according to the present embodiment has a bolt-clamped Langevin-type transducer (BLT) including an unillustrated piezoelectric element. To the BLT, there is connected a conical horn, i.e., vibration amplifier, for amplifying ultrasonic vibrations. A cylindrical vibration transmitting bar, i.e., a vibration transmitter, for transmitting the amplified ultrasonic vibrations is connected to a leading end of the horn. The horn and the vibration transmitting bar jointly make up the vibration amplifying and transmitting member 16. The ultrasonic vibration applying unit 14 is not limited to the illustrated structure, and may be of other structures.

An unillustrated oscillator for generating a high-frequency electric signal is electrically connected to the ultrasonic vibration applying unit 14. When the oscillator generates and supplies a high-frequency electric signal to the ultrasonic vibration applying unit 14, the ultrasonic vibration applying unit 14 generates ultrasonic vibrations. In the surface unevenness forming step S10 according to the present embodiment, the ultrasonic vibrations generated by the ultrasonic vibration applying unit 14 have a frequency having a predetermined value ranging from 16 kHz to 100 kHz, e.g., a frequency of 20 kHz, and an output level having a predetermined value ranging from 5.0 W to 100 W, e.g., an output level of 30 W.

Further, after the ultrasonic vibration applying unit 14 has applied ultrasonic vibrations to the annular base 4 for 1 minute or more, preferably 3 minutes or more, while remaining still with respect to the annular base 4, the ultrasonic vibration applying unit 14 is moved a predetermined distance along one of the circumferential directions 4A of the annular slot 4*d*. The application of ultrasonic vibrations to the annular base 4 and the movement of the ultrasonic vibration applying unit 14 in and along the annular slot 4*d* are alternately repeated to apply ultrasonic vibrations to the annular base 4 fully along the circumferential directions 4A of the annular slot 4*d*.

The ultrasonic vibrations thus applied to the annular base 4 produce the third surface unevennesses $4e_3$ on either side surfaces $4d_1$, i.e., an inner circumferential side surface $4d_{1A}$ and an outer circumferential side surface $4d_{1B}$, and a bottom surface $4d_2$ of the annular slot 4*d* or both the side surfaces $4d_1$ and the bottom surface $4d_2$. The water 10 does not contain abrasive grains that would damage the annular base 4. Consequently, it is speculated that the third surface unevennesses $4e_3$ are produced by shock waves generated when air bubbles in the water 10 are imploded, i.e., by a cavitation effect.

Figure 3A:
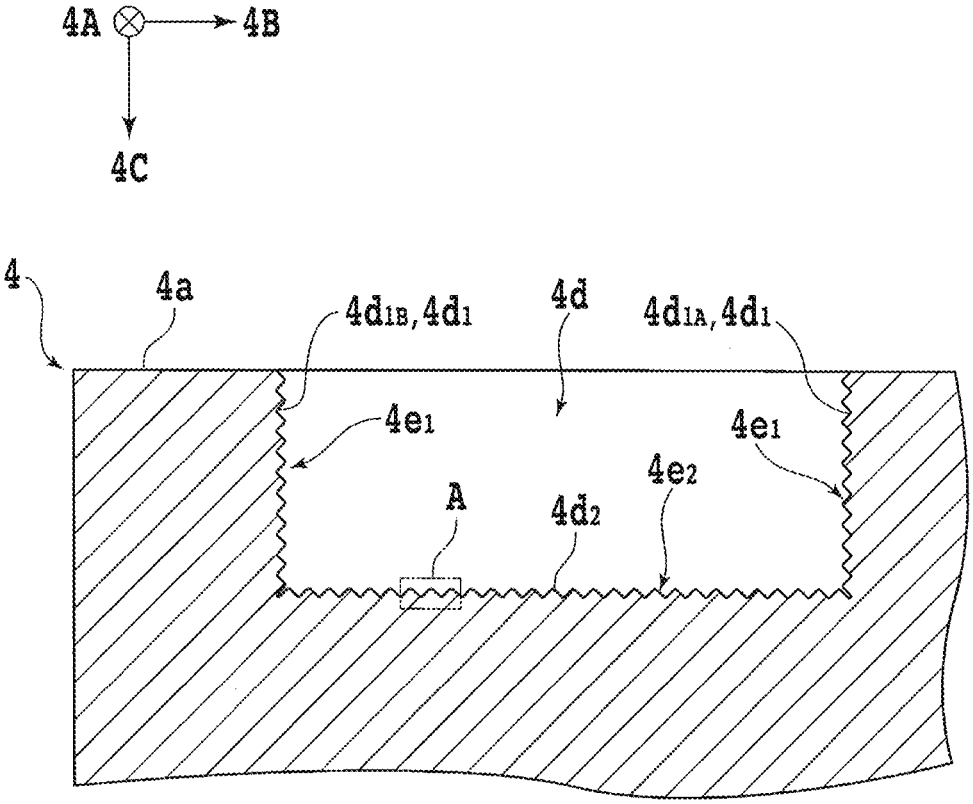
FIG. 3A is an enlarged fragmentary cross-sectional view of an annular slot.

As illustrated in FIG. 3A, when the annular base 4 is cut by a machining center, surface unevennesses are produced and left in periodic patterns on each of the side surfaces $4d_1$, i.e., the inner circumferential side surface $4d_{1A}$ and the outer circumferential side surface $4d_{1B}$, and the bottom surface $4d_2$. Specifically, first surface unevennesses $4e_1$ that are periodic along thicknesswise directions 4C of the annular base 4 are produced on the inner circumferential side surface $4d_{1A}$ and the outer circumferential side surface $4d_{1B}$. According to the present embodiment, the first surface unevennesses $4e_1$ are defined by a plurality of grooves that are substantially parallel to each other along the circumferential directions 4A of the annular base 4.

Similarly, second surface unevennesses $4e_2$ that are periodic along the radial directions 4B of the annular base 4 are produced on the bottom surface $4d_2$. According to the present embodiment, the second surface unevennesses $4e_2$ are also defined by a plurality of grooves that are substantially parallel to each other along the circumferential directions 4A of the annular base 4. FIG. 3A illustrates the annular slot 4*d* in enlarged fragmentary cross section. In FIG. 3A, the circumferential directions 4A, the radial directions 4B, and the thicknesswise directions 4C of the annular base 4 extend perpendicularly to each other.

For illustrative purposes, the first surface unevennesses $4e_1$ on the side surfaces $4d_1$ and the second surface unevennesses $4e_2$ on the bottom surface $4d_2$ are illustrated as exaggerated in FIG. 3A. In reality, however, the first surface unevennesses $4e_1$ and the second surface unevennesses $4e_2$ are extremely small. For example, the first surface unevennesses $4e_1$ and the second surface unevennesses $4e_2$ have a periodic interval, i.e., a pitch, ranging from 80 μm to 100 μm, e.g., a periodic interval of 90 μm, and a depth ranging from 20 μm to 100 μm, e.g., a depth of 30 μm. Consequently, the first surface unevennesses $4e_1$ and the second surface unevennesses $4e_2$ are usually invisible to the naked eye.

Figure 3B:
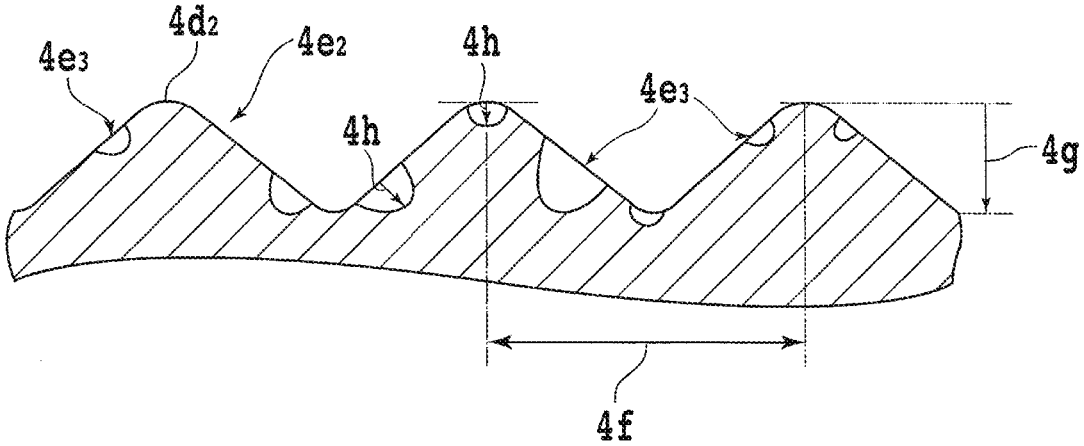
FIG. 3B is an enlarged view of a region A illustrated in FIG. 3A.

FIG. 3B illustrates at an enlarged scale a region A of the bottom surface $4d_2$ illustrated in FIG. 3A. In FIG. 3B, a pitch 4*f* and a depth 4*g* of the second surface unevennesses $4e_2$ on the bottom surface $4d_2$ are illustrated. According to the present embodiment, the pitch 4*f* represents the distance between two adjacent peaks of the second surface unevennesses $4e_2$, though it may represent the distance between two adjacent valleys thereof. According to the present embodiment, the depth 4*g* represents the distance between a peak whose height is the largest and a valley whose height is the smallest over a predetermined length, i.e., a reference length, extracted from a roughness curve, and is referred to as a maximum height Rz (JIS B 0601:2013, ISO 4287:1997) corresponding to a maximum height Ry (JIS B 0601:1994).

In the surface unevenness forming step S10, ultrasonic vibrations are applied to the annular slot 4*d* to form the third surface unevennesses $4e_3$ on either the side surfaces $4d_1$ or the bottom surface $4d_2$ or both the side surfaces $4d_1$ and the bottom surface $4d_2$. The third surface unevennesses $4e_3$ on the bottom surface $4d_2$ are made up of the surfaces of the periodic second surface unevennesses $4e_2$ and a plurality of holes formed in the bottom surface $4d_2$ in the surface unevenness forming step S10. Likewise, the third surface unevennesses $4e_3$ on the side surfaces $4d_1$ are made up of the surfaces of the periodic first surface unevennesses $4e_1$ and a plurality of holes formed in the side surfaces $4d_1$ in the surface unevenness forming step S10.

The third surface unevennesses $4e_3$ have a depth 4*h* smaller than the depth 4*g* of the first surface unevennesses $4e_1$ and the second surface unevennesses $4e_2$. The depth 4*h* is, for example, 10 μm. As illustrated in FIG. 3B, the depth 4*h* of the third surface unevennesses $4e_3$ on the surfaces of the periodic second surface unevennesses $4e_2$ is defined, for example, by a maximum depth of holes in a direction normal to the surfaces of the second surface unevennesses $4e_2$ free of holes. Unlike the periodic first surface unevennesses $4e_1$ and the periodic second surface unevennesses $4e_2$, the third surface unevennesses $4e_3$ are randomly formed. According to the present embodiment, the third surface unevennesses $4e_3$ are formed in both the side surfaces $4d_1$ and the bottom surface $4d_2$. However, the third surface unevennesses $4e_3$ may be formed in only the bottom surface $4d_2$ or in only the side surfaces $4d_1$.

After the surface unevenness forming step S10, the annular base 4 is removed from the water tank 12 and dried. Then, after the adhesive 7 in liquid phase has been supplied to the annular slot 4*d*, the grindstones 6 are inserted into the annular slot 4*d* (see FIG. 4). The adhesive 7 is solidified to fix the grindstones 6 to the surfaces that define the annular slot 4*d* with the adhesive 7 (grindstone fixing step S20).

Figure 4:
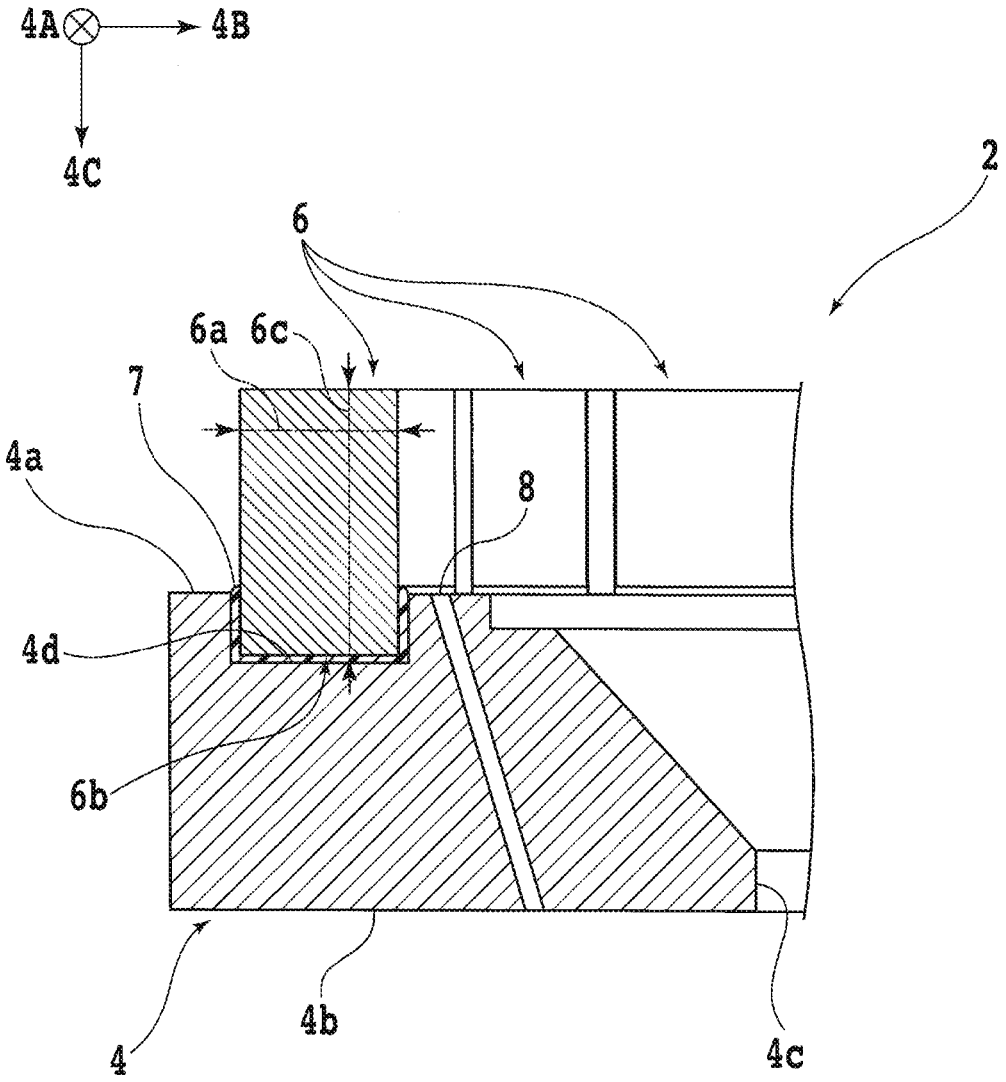
FIG. 4 is a fragmentary cross-sectional view illustrating a grindstone fixing step of the method according to the embodiment.

FIG. 4 illustrates in fragmentary cross section the grindstone fixing step S20 of the method according to the present embodiment. The adhesive 7 is not limited to a thermosetting resin, and may be a two-liquid-mixture cold setting resin that starts being set when a main agent and a setting agent are mixed with each other or an ultraviolet-curable resin that starts being cured upon exposure to ultraviolet rays.

FIG. 5 illustrates in perspective the grinding wheel 2 manufactured according to the flowchart illustrated in FIG. 1. According to the present embodiment, since the third surface unevennesses $4e_3$ formed in the annular slot 4*d* by the applied ultrasonic vibrations increase the area of contact between the annular base 4 and the adhesive 7, the bonding strength with which the grindstones 6 are fixed to the annular base 4, i.e., the degree of intimate contact thereof with the annular base 4, is increased.

In the surface unevenness forming step S10, the annular base 4 may be placed on a rotatable table, and the rotatable table may be rotated relatively slowly at a predetermined rotational speed. Alternatively, rather than employing a rotatable table, a ring-shaped vibration member that can be fitted in the annular slot 4*d* may be used instead of the vibration amplifying and transmitting member 16 and may apply ultrasonic vibrations simultaneously to the annular slot 4*d* in its entirety. Moreover, in the surface unevenness forming step S10, ultrasonic vibrations may be applied to the annular slot 4*d* while the water 10 such as pure water is being supplied from an unillustrated nozzle to the gap between the vibration amplifying and transmitting member 16 and the surfaces defining the annular slot 4*d*, rather than immersing the annular base 4 in the water tank 12 containing the water 10.

Figure 6:
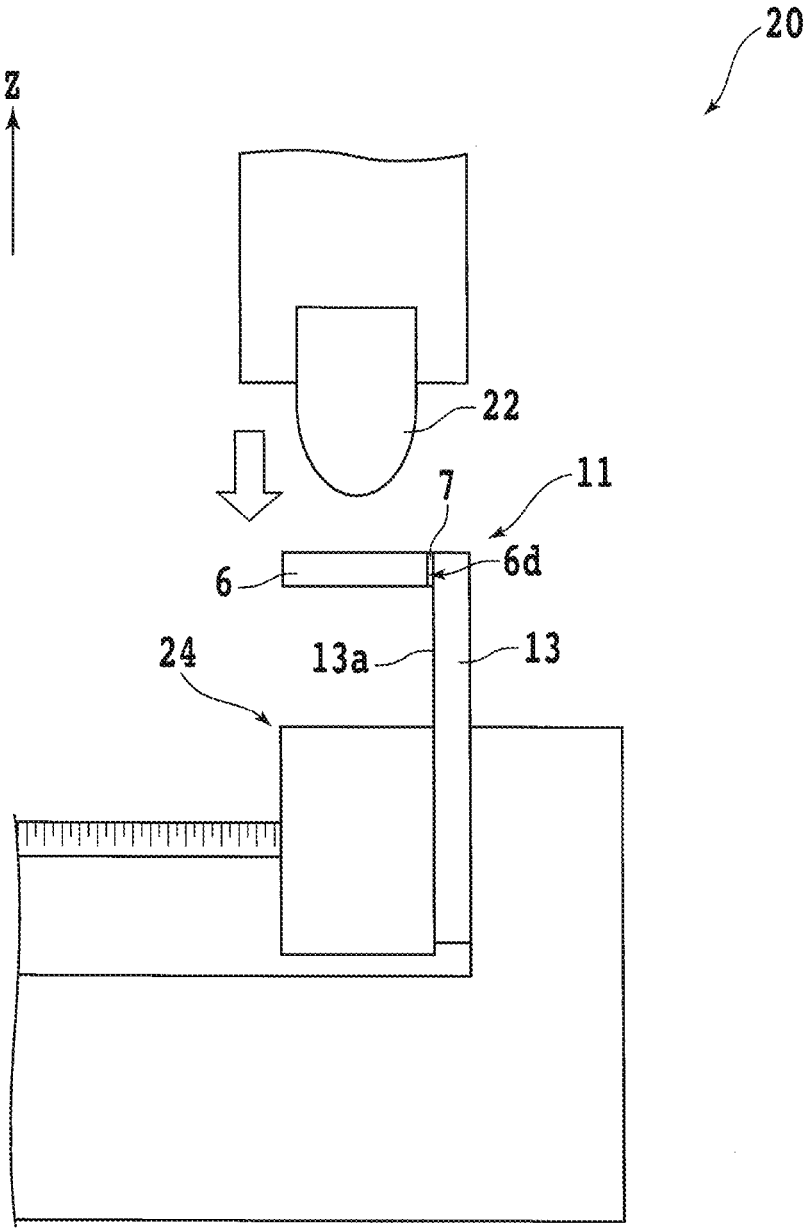
FIG. 6 is an elevational view of a universal testing machine.

Next, the results of an experimental bending test will be described below with reference to FIGS. 6 through 11. In the experimental test, a universal testing machine manufactured by SHIMADZU CORPORATION (model number: AG50-kNG) was used as a universal testing machine 20. First, structural details of the universal testing machine 20 will be described below with reference to FIG. 6. FIG. 6 schematically illustrates the universal testing machine 20. As illustrated in FIG. 6, the universal testing machine 20 has an indenter 22 that can be lowered along a Z-axis. The indenter 22 is of a cylindrical shape having a diameter of 3 mm and has lengthwise directions parallel to the Z-axis.

In the experimental test, a test piece 11 was secured in position by a vise 24 located at the bottom of the universal testing machine 20, and the indenter 22 was lowered at a rate of 1 mm/min. The test piece 11 used in the experimental test had a disk-shaped base 13 made of aluminum alloy. The disk-shaped base 13 had a surface 13*a* that has been cut by a machining center and that had periodic surface unevennesses left thereon as with the side surfaces $\mathbf{4}d_1$ and the bottom surface $\mathbf{4}d_2$ of the annular base 4 (see FIGS. 9A, 9B, etc.).

The pitch of the surface unevennesses on the surface 13*a* of the disk-shaped base 13 was of approximately 90 μm whereas the depth (Rz) of the surface unevennesses was of approximately 30 μm. A surface 6*d* of the grindstone 6 that corresponds to the base end portion 6*b* of the grindstone 6 to be inserted in the annular slot 4*d* was fixed to the surface 13*a* of the disk-shaped base 13 by the adhesive 7. In the experimental test, there were prepared a disk-shaped base 13 that had not been subjected to the surface unevenness forming step S10 and a disk-shaped base 13 having a predetermined area of the surface 13*a* to be coated with the adhesive 7 to which area ultrasonic vibrations had been applied in the surface unevenness forming step S10.

Specifically, two first test pieces 11 where the grindstones 6 are fixed by the adhesive 7 to the disk-shaped base 13 not subjected to the surface unevenness forming step S10 and two second test pieces 11 where ultrasonic vibrations are applied for 30 seconds in the surface unevenness forming step S10 were produced. Further, two third test pieces 11 where ultrasonic vibrations are applied for 1 minute in the surface unevenness forming step S10 and two fourth test pieces 11 where ultrasonic vibrations are applied for 3 minutes in the surface unevenness forming step S10 were produced.

The adhesive 7 was made of a one-liquid thermosetting epoxy resin. The adhesive 7 was applied at a ratio of 160 g/m$^2$ to an area of the surface 13*a* which corresponds to the surfaces 6*d* of the grindstones 6, and solidified at 120° C. for 2 hours. The grindstones 6 were thus fixed in a cantilevered fashion to the surface 13*a*. While the disk-shaped base 13 was being fastened in position by the vise 24, the indenter 22 was lowered substantially perpendicularly to side surfaces of the grindstones 6. At this time, after the adhesive 7 was ruptured until the grindstones 6 peeled off from the disk-shaped base 13, a maximum stress (MPa) applied to the indenter 22 was measured.

Figure 7:
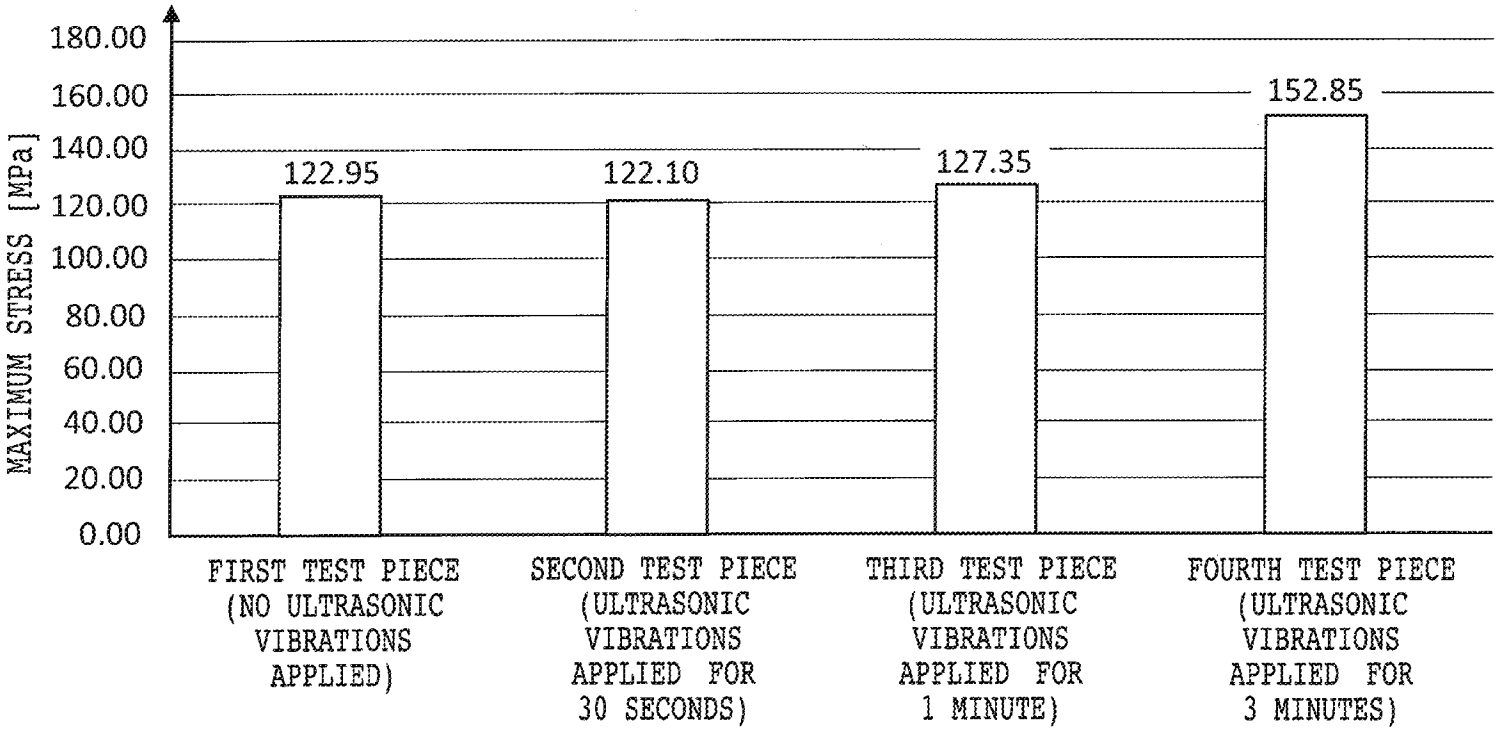
FIG. 7 is a graph illustrating the results of an experimental test for bending cantilevered grindstones.

FIG. 7 is a graph illustrating the results of the experimental test for bending the cantilevered grindstones 6. FIG. 7 illustrates smaller values, i.e., minimum values, of maximum stresses measured when the grindstones 6 peeled off from the disk-shaped base 13 in the first through fourth test pieces 11, each provided as two units. The minimum value of the maximum stresses applied to the indenter 22 in the test on the two first test pieces 11 was 122.95 MPa. The minimum value of the maximum stresses in the test on the two second test pieces 11 was 122.10 MPa. The minimum value of the maximum stresses in the test on the two third test pieces 11 was 127.35 MPa. The minimum value of the maximum stresses in the test on the two fourth test pieces 11 was 152.85 MPa.

Thus, the longer the time in which the ultrasonic vibrations were applied is, the higher the bonding strength with which the disk-shaped base 13 and the grindstones 6 were bonded to each other, i.e., the degree of intimate contact therebetween, is. It can be seen from the results of the experiment that the time in which ultrasonic vibrations are applied to the area where the grindstones 6 are fixed should preferably be 1 minute or more and more preferably be 3 minutes or more.

Figure 8:
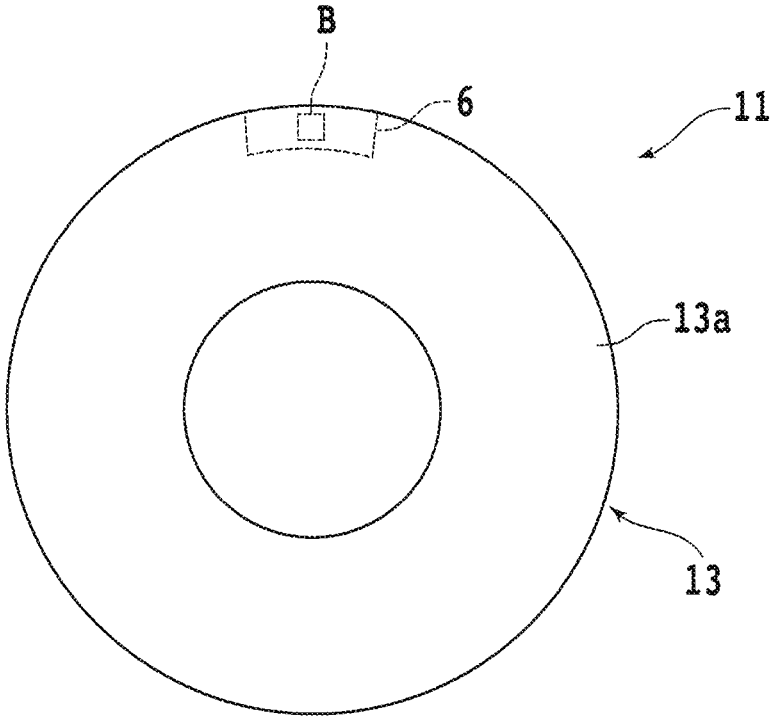
FIG. 8 is a plan view of a disk-shaped base of the universal testing machine.
Figure 9A:
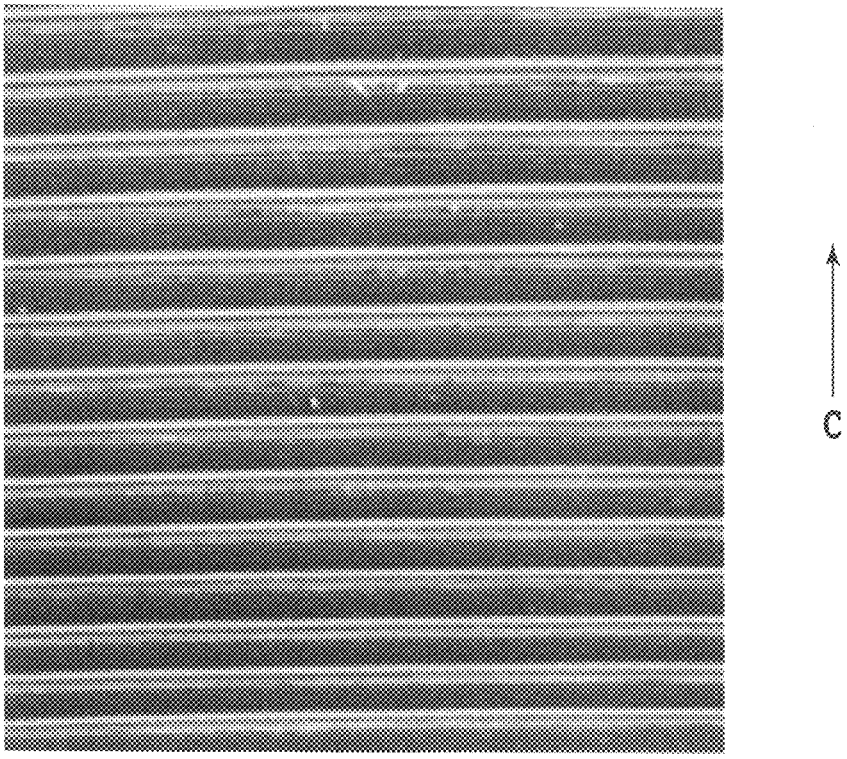
FIG. 9A is an enlarged photographic representation of a region B illustrated in FIG. 8 where no ultrasonic vibrations are applied.
Figure 10A:
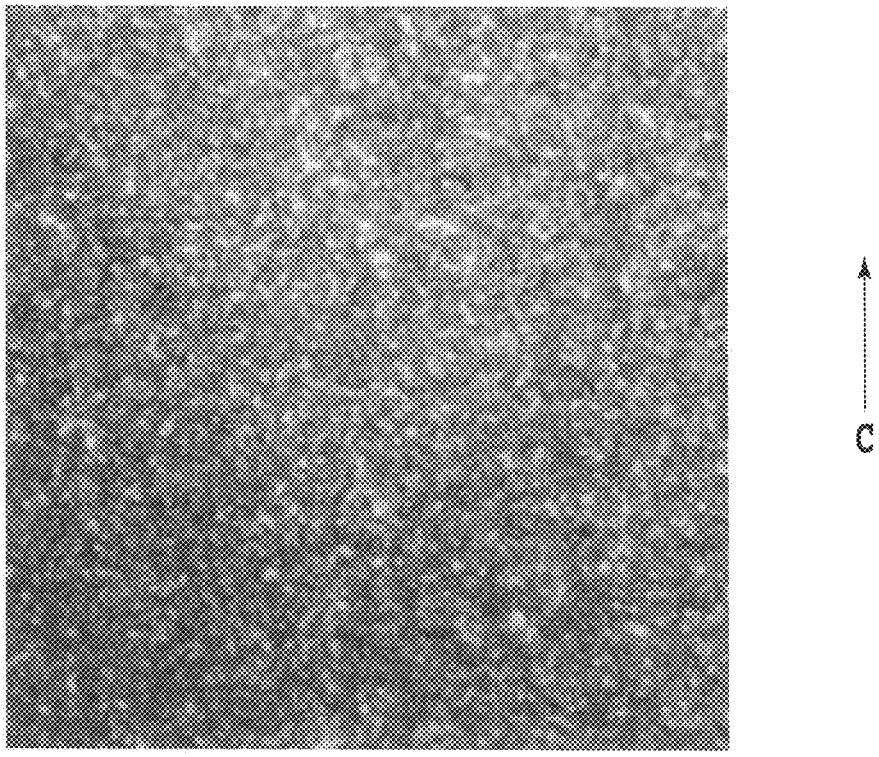
FIG. 10A is an enlarged photographic representation of the region B obtained after cutting and sandblasting.
Figure 11A:
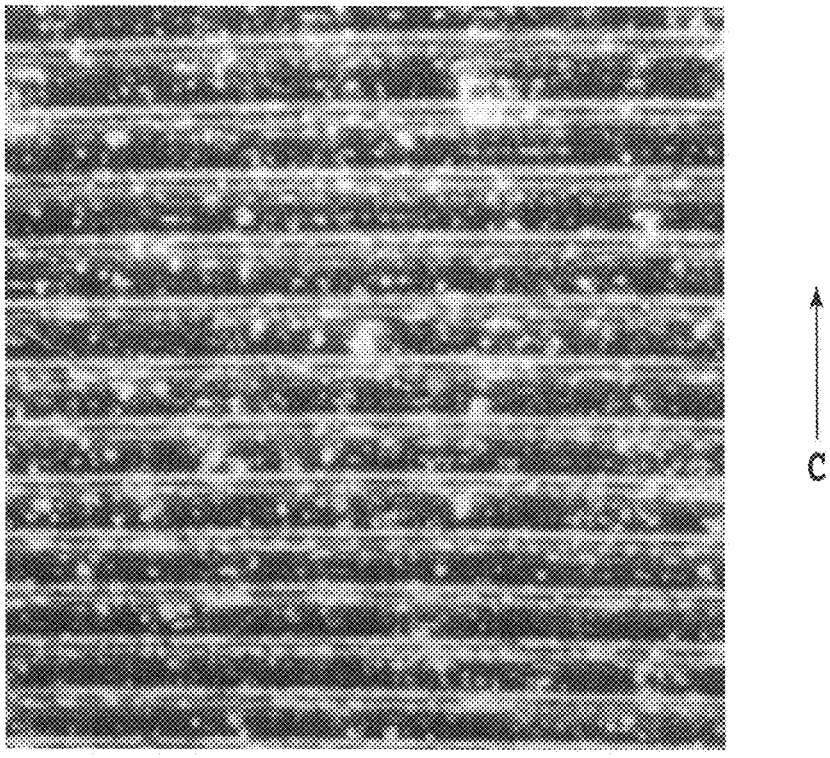
FIG. 11A is an enlarged photographic representation of the region B obtained after cutting and applying ultrasonic vibrations.

The results of an observation of the surface 13*a* of the disk-shaped base 13 used in the experimental test will be described below. FIG. 8 illustrates the disk-shaped base 13 in plan. FIGS. 9A, 10A, and 11A are photographic representations of a region B of the area where the grindstones 6 are fixed by the adhesive 7. FIG. 9A is an enlarged photographic representation of the region B of the surface 13*a* of the disk-shaped base 13, corresponding to the first test pieces 11, which has been cut by a machining center, but no ultrasonic vibrations have been applied thereto.

Figure 9B:
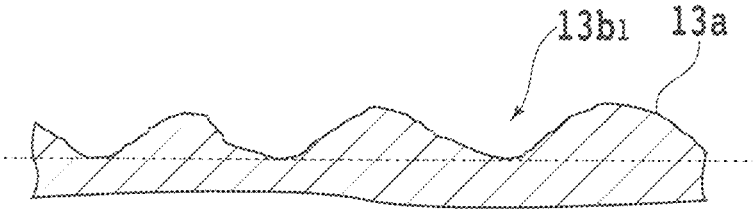
FIG. 9B is a cross-sectional view illustrating the contour of a cross section of the disk-shaped base.

FIG. 9B illustrates the contour of a cross section of the disk-shaped base 13 in a plane parallel to the direction indicated by an arrow C in FIG. 9A and perpendicular to the surface 13*a*. A broken line in FIG. 9B corresponds to valleys of periodic surface unevennesses $\mathbf{13}b_1$ on the surface 13*a*. The periodic surface unevennesses $\mathbf{13}b_1$ correspond to the first surface unevennesses $\mathbf{4}e_1$ and the second surface unevennesses $\mathbf{4}e_2$ of the annular slot 4*d*.

Figure 10B:
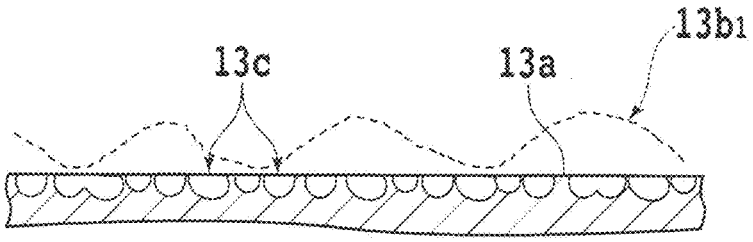
FIG. 10B is a cross-sectional view illustrating the contour of a cross section of the disk-shaped base.

FIG. 10A is an enlarged photographic representation of the region B of the surface 13*a* of the disk-shaped base 13 obtained after cutting by a machining center and sandblasting. FIG. 10B illustrates the contour of a cross section of the disk-shaped base 13 in a plane parallel to the direction indicated by the arrow C in FIG. 10A and perpendicular to the surface 13*a*. A broken line in FIG. 10B indicates that the periodic surface unevennesses $\mathbf{13}b_1$ on the surface 13*a* has disappeared.

As illustrated in FIG. 10B, the surface 13*a* that has been sandblasted has extremely small surface unevennesses 13*c* formed substantially randomly. The disk-shaped base 13 was sandblasted by a commercially available sandblasting apparatus under 0.5 MPa for 3 minutes, using polygonally shaped particles made of a white alundum (WA), i.e., molten alumina, material and having a central particle size, i.e., a 50% diameter or median diameter, ranging from 45 μm to 75 μm. The above bending test was conducted on the sandblasted test pieces 11. The minimum value of the maximum stresses in the test on the two sandblasted test pieces 11 was 136.85 MPa.

The sandblasting process can thus contribute to an increase in the bonding strength of the adhesive 7 that bonds the disk-shaped base 13 and the grindstones 6 to each other. However, because the sandblasting process applies a powdery material under a high pressure to the disk-shaped base 13, the powdery material tends to adhere to the disk-shaped base 13. Hence, when the disk-shaped base 13 has been sandblasted, the disk-shaped base 13 needs to be cleaned to remove the deposited powdery material, resulting in an increase in the number of man-hours required. The same problem occurs when the annular base 4 is sandblasted. By contrast, when surface unevennesses are formed on the annular base 4 by ultrasonic vibrations applied thereto as in the surface unevenness forming step S10, it is not necessary to clean the annular base 4 after surface unevennesses have been formed thereon because no abrasive grains are used.

FIG. 11A is an enlarged photographic representation of the region B obtained after cutting by a machining center and ultrasonic vibrations have been applied. Specifically, FIG. 11A is a photographic representation of the disk-shaped base 13, corresponding to the fourth test pieces 11, where ultrasonic vibrations were applied for 3 minutes in the surface unevenness forming step S10.

Figure 11B:
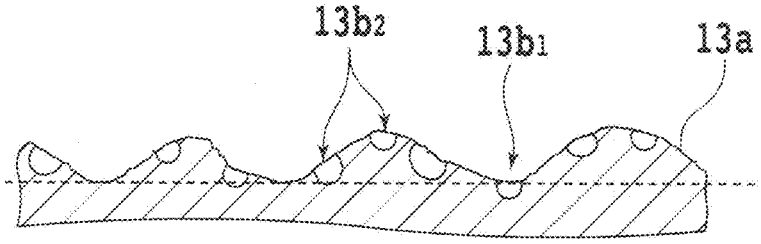
FIG. 11B is a cross-sectional view illustrating the contour of a cross section of the disk-shaped base.

FIG. 11B illustrates the contour of a cross section of the disk-shaped base 13 in a plane parallel to the direction indicated by the arrow C in FIG. 11A and perpendicular to the surface 13*a*. A broken line in FIG. 11B corresponds to valleys of periodic surface unevennesses $\mathbf{13}b_1$ on the surface 13*a*. The periodic surface unevennesses $\mathbf{13}b_1$ correspond to the first surface unevennesses $\mathbf{4}e_1$ and the second surface unevennesses $\mathbf{4}e_2$ as described above. As illustrated in FIG. 11B, the application of ultrasonic vibrations makes it possible to form extremely small surface unevennesses $\mathbf{13}b_2$, which correspond to the third surface unevennesses $\mathbf{4}e_3$, smaller than the surface unevennesses $\mathbf{13}b_1$, while keeping the periodic surface unevennesses $\mathbf{13}b_1$ left on the surface 13*a* that have been formed by cutting.

Inasmuch as the extremely small surface unevennesses $\mathbf{13}b_2$ formed by the application of ultrasonic vibrations increase the area of contact between the disk-shaped base 13 and the adhesive 7, the bonding strength between the disk-shaped base 13 and the grindstones 6, i.e., the degree of intimate contact between the disk-shaped base 13 and the grindstones 6, is considered to be increased.

The technical scope of the present invention is not limited to the scope described in the above embodiment. The details of the structure, the method, etc., according to the above embodiment may be changed or modified without departing from the scope of the present invention. For example, although the annular base 4 is immersed in the water 10 in the water tank 12 such that the surface 4*a* of the annular base 4 faces upwardly in the surface unevenness forming step S10, the surface 4*a* of the annular base 4 may face laterally or downwardly as long as ultrasonic vibrations can be applied through the water 10 to the annular base 4.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding wheel comprising:

an annular base having an annular slot defined in a surface thereof along circumferential directions thereof; and a plurality of grindstones fixed to the annular slot by an adhesive, wherein the annular slot is defined by side surfaces having first surface unevennesses that are periodic in thicknesswise directions perpendicular to the circumferential directions, the annular slot is defined by a bottom surface having second surface unevennesses that are periodic in radial directions perpendicular to the circumferential directions and the thicknesswise directions, and wherein at least one of the first surface unevennesses of the side surfaces and the second surface unevennesses of the bottom surface of the annular slot include third surface unevennesses, the third surface unevennesses having a depth smaller than that of the first surface unevennesses and the second surface unevennesses.

2. The grinding wheel of claim 1, wherein the third surface unevennesses on the side surfaces of the annular slot include a plurality of holes formed in the side surfaces.

3. The grinding wheel of claim 2, wherein the third surface unevennesses on the bottom surface of the annular slot include a plurality of holes formed in the bottom surface.

4. The grinding wheel of claim 1, wherein the third surface unevennesses on the bottom surface of the annular slot include a plurality of holes formed in the bottom surface.

5. The grinding wheel of claim 1, wherein the annular base includes a plurality of liquid supply ports spaced at substantially equal intervals along the circumferential directions of the annular base.

6. The grinding wheel of claim 1, wherein the annular base includes an inner circumferential side surface that is slanted inwardly from the top surface to the bottom surface of the annular base.

* * * * *